US009545634B2

(12) United States Patent
Fox

(10) Patent No.: US 9,545,634 B2
(45) Date of Patent: Jan. 17, 2017

(54) OFFSET SAMPLE TUBE HOLDER

(71) Applicant: TriPath Imaging, Inc., Burlington, SC (US)

(72) Inventor: William Alan Fox, Lake Wylie, SC (US)

(73) Assignee: TriPath Imaging, Inc., Burlington, NC (US)

( * ) Notice: Subject to any disclaimer, the term of this patent is extended or adjusted under 35 U.S.C. 154(b) by 0 days.

(21) Appl. No.: 14/443,897

(22) PCT Filed: Nov. 20, 2013

(86) PCT No.: PCT/US2013/070985

§ 371 (c)(1),
(2) Date: May 19, 2015

(87) PCT Pub. No.: WO2014/081818

PCT Pub. Date: May 30, 2014

(65) Prior Publication Data

US 2015/0298131 A1 Oct. 22, 2015

Related U.S. Application Data

(60) Provisional application No. 61/728,540, filed on Nov. 20, 2012.

(51) Int. Cl.
*B01L 9/06* (2006.01)
*B01L 3/00* (2006.01)

(52) U.S. Cl.
CPC ..... *B01L 9/06* (2013.01); *B01L 3/5021* (2013.01); *B01L 2200/021* (2013.01); *B01L 2200/025* (2013.01); *B01L 2200/028* (2013.01)

(58) Field of Classification Search
CPC ..... B01L 9/06; B01L 2200/028
(Continued)

(56) References Cited

U.S. PATENT DOCUMENTS

D204,258 S 4/1966 Barrantes
4,411,868 A * 10/1983 Noack ..... B01L 9/06 211/60.1

(Continued)

FOREIGN PATENT DOCUMENTS

CN 202516586 U 11/2012

OTHER PUBLICATIONS

International Search Report for Application No. PCT/US2013/070985 dated Apr. 9, 2014.

*Primary Examiner* — Paul Hyun
(74) *Attorney, Agent, or Firm* — Lerner, David, Littenberg, Krumholz & Mentlik, LLP

(57) ABSTRACT

A sample tube holder assembly may include a base comprising a base cavity defined therein. The sample tube holder assembly may include at least one first engagement member disposed within the base cavity and a plurality of sample tube holder racks configured to be received within the base cavity, at least one of the sample tube holder racks comprising at least one second engagement member, wherein each of the plurality of sample tube holder racks further comprises at least one sample tube cavity configured to receive a respective sample tube therein. The first and second engagement members may be configured to engage with one another when the plurality of sample tube holder racks are positioned within the base cavity such that the sample tube holder racks are offset at a different depth from one another within the base cavity.

13 Claims, 9 Drawing Sheets

(58) Field of Classification Search
USPC ..... 422/561, 562
See application file for complete search history.

(56) References Cited

U.S. PATENT DOCUMENTS

| | | | | |
|---|---|---|---|---|
| 2005/0265901 | A1 | 12/2005 | Sinclair et al. | |
| 2008/0098830 | A1* | 5/2008 | | Martinell |
| | | | Gispert-Sauch ..... | B01L 9/06 73/864.91 |
| 2009/0065458 | A1 | 3/2009 | Murray | |
| 2012/0051987 | A1 | 3/2012 | Johnson et al. | |

* cited by examiner

OFFSET SAMPLE TUBE HOLDER

CROSS-REFERENCE TO RELATED APPLICATIONS

The present application is a national phase entry under 35 U.S.C. §371 of International Application No. PCT/US2013/070985, filed on Nov. 20, 2013, published in English, which claims priority from U.S. Provisional Patent Application No. 61/728,540 filed Nov. 20, 2012, all of which are incorporated herein by reference.

TECHNICAL FIELD AND BACKGROUND OF THE INVENTION

Embodiments of the present invention relate generally relates to an apparatus and a method for identifying a plurality of sample tubes in a sample tube holder. Accurate identification of sample tubes containing specimen samples therein is essential when testing multiple specimen samples. Typically sample tubes include a visual identifier, such as a barcode or other identification label, such that a user may distinguish one particular specimen sample from another.

When a plurality of sample tubes that include an identifier are disposed within a sample tube holder along the same plane, the identification of sample tubes disposed within the interior of the sample tube holder becomes difficult. As such, a user may remove a sample tube to identify the sample tube and then replace the sample tube to its original position. Further, when a sample tube is disposed within a sample tube holder, a user may remove the sample tube from the holder to visually inspect the sample stored within the sample tube. Accordingly, when multiple sample tubes are handled, manipulated, and/or otherwise processed, returning a particular sample tube to its original position within the sample tube holder may be difficult and may lead to repositioning errors. As such, a need exists for an assembly configured to minimize errors while identifying, handling, and/or otherwise processing a sample disposed within a sample tube.

BRIEF SUMMARY

Various embodiments of the present invention are directed to a sample tube holder assembly. In one embodiment, the sample tube holder assembly comprises a base comprising a base cavity defined therein. In addition, the sample tube holder assembly may include at least one first engagement member disposed within the base cavity and a plurality of sample tube holder racks configured to be received within the base cavity. At least one of the sample tube holder racks may comprise at least one second engagement member, wherein each of the plurality of sample tube holder racks further comprises at least one sample tube cavity configured to receive a respective sample tube therein. In addition, the first and second engagement members may be configured to engage with one another when the plurality of sample tube holder racks are positioned within the base cavity such that the sample tube holder racks are offset at a different depth from one another within the base cavity.

In some embodiments, the first engagement feature may comprise a rod and the second engagement feature may comprise a rod cavity. According to one embodiment, the sample tube holder assembly may further comprise a base plate configured to be received within the base cavity, wherein the first engagement feature extends outwardly from a top surface of the base plate. In addition, each of the sample tube holder racks may include a top surface and a bottom surface, wherein the at least one sample tube cavity is defined on the top surface and the at least one second engagement member is defined on the bottom surface. According to some embodiments, the sample tube holder rack may further comprise at least one rack engagement feature defined on an outer surface thereof configured to couple at least one sample tube holder rack to another sample tube holder rack. In one embodiment, the rack engagement feature may provide a tongue and groove engagement.

The sample tube holder assembly may further comprise a plurality of first engagement members, wherein the first engagement members have differing lengths. According to one embodiment, the base may comprise a front surface and a rear surface and at least one of the first engagement members disposed proximate to the rear surface may have a greater length than at least one of the first engagement members disposed proximate to the front surface. The sample tube holder assembly may further comprise a plurality of first engagement members, wherein each of the sample tube holder racks comprises a plurality of second engagement members, each of the second engagement members configured to engage a respective one of the first engagement members. In some embodiments, the plurality of first engagement members may be arranged in a series of rows, each of the rows having a plurality of engagement members that are of a different length than another row.

In some embodiments, the base may be configured to receive at least three sample tube holder racks within the base cavity. According to one embodiment, the plurality of sample tube holder racks may be configured to receive a respective sample tube therein such that the sample tube indicia disposed on each of the sample tubes is visible when the sample tube is inserted within the sample tube holder rack.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention will now be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like, to the extent used herein, do not imply a required limitation in all embodiments of the present invention, but rather are used herein to help describe relative direction or orientation in the example embodiments illustrated in the figures.

Various embodiments of the present invention generally provide for an assembly for positioning, identifying, inspecting, storing, processing, and/or handling a plurality of sample tubes disposed within a sample tube holder. For example, the sample tube holder may be configured to receive a plurality of sample tubes disposed therein and may be further configured to be disposed within a centrifuge for centrifuging a sample disposed within the sample tubes. In addition, a plurality of sample tubes may include an identification label, such as a barcode or other identifier, affixed to the sample tube so that a technician and/or an automated device may identify each particular sample tube during processing thereof. Further, the sample tube holder may be configured to provide for the identification of a sample tube disposed within the holder such that a user may be able to correctly and easily identify the samples stored within the tube holder after being processed, such as after being spun by a centrifuge. Accordingly, embodiments of the present invention may facilitate the identification of any one of a multiple of sample tubes while the sample tubes are disposed within a sample tube holder. In one embodiment, the sample tubes are configured to be offset from one another when disposed within the sample tube holder such that at least one of the sample tubes is positioned at a different depth therein, thereby facilitating visibility of the sample tubes. In addition, some embodiments may provide for the inspection, storing, handling, and/or processing of a sample contained within any one of a plurality of sample tubes.

Figure 1:
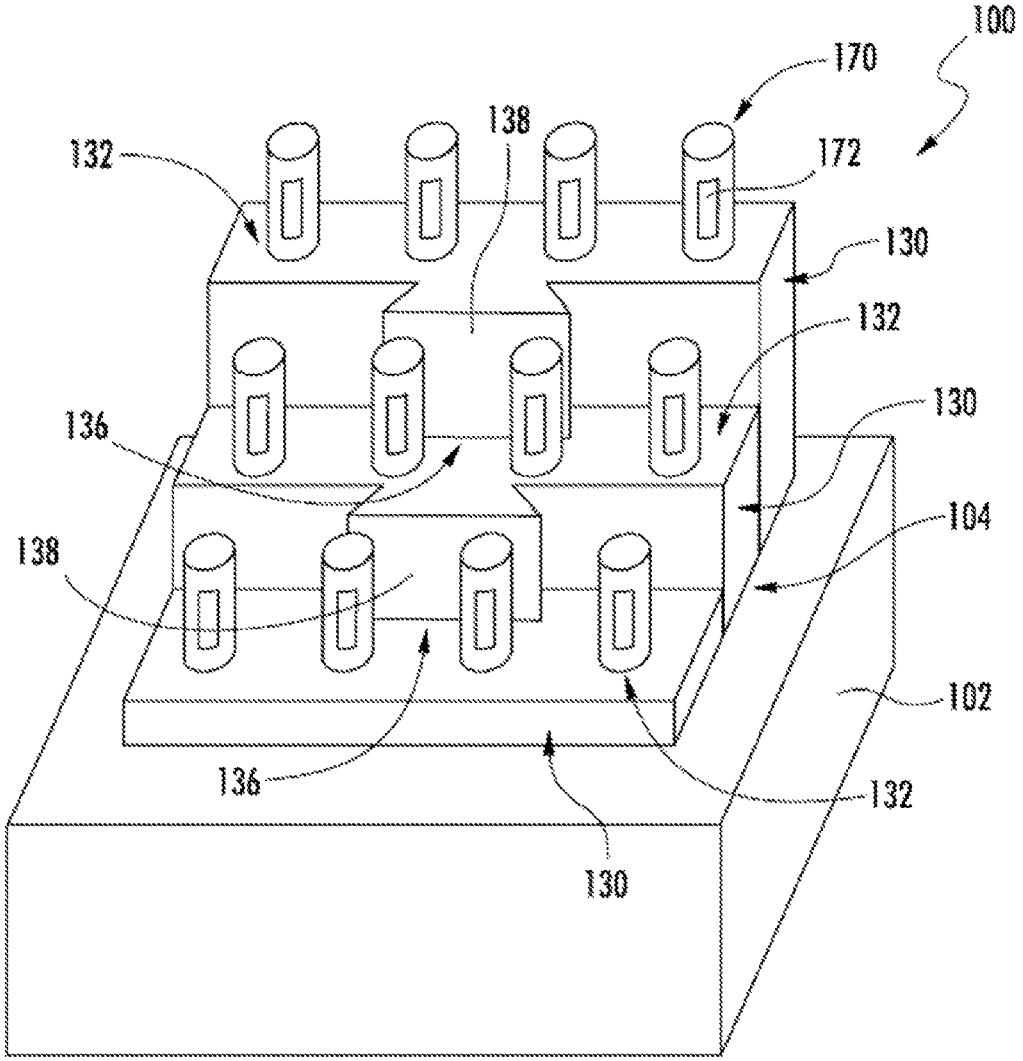
FIG. 1 illustrates a sample tube holder assembly for storing and/or identifying specimen samples within sample tubes according to some embodiments of the present invention.
Figure 2:
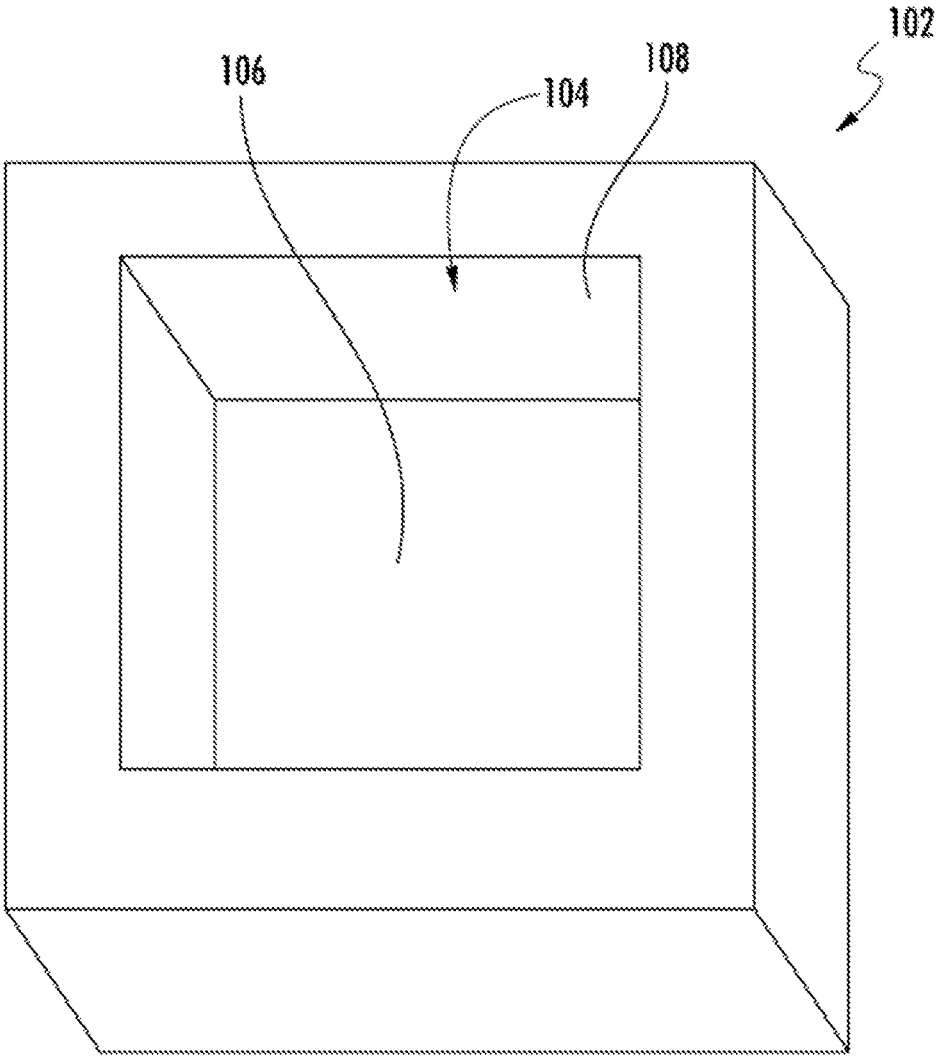
FIG. 2 illustrates a sample tube holder base according to some embodiments of the present invention.
Figure 3A:
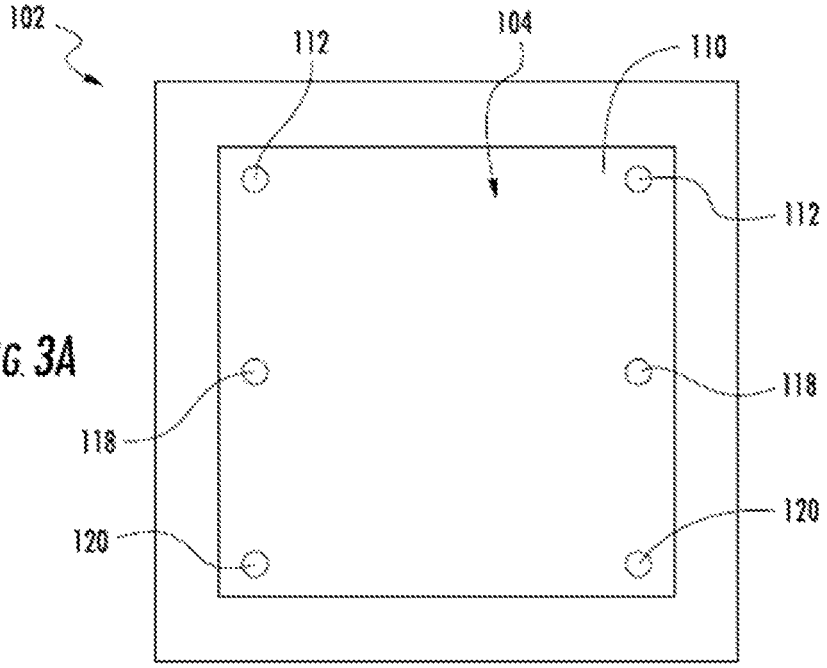
FIG. 3A illustrates a top view of a sample tube holder base according to some embodiments of the present invention.
Figure 3B:
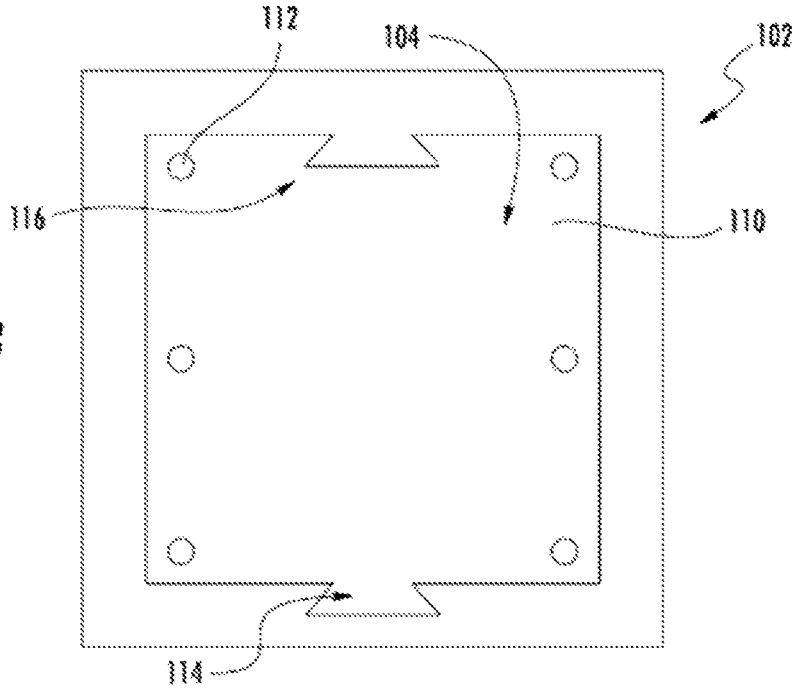
FIG. 3B illustrates a top view of a sample tube holder base according to some embodiments of the present invention.

In this regard, FIG. 1 illustrates a sample tube holder assembly 100 according to one embodiment of the present invention. Specifically, the sample tube holder assembly 100 may comprise a tube holder base 102, as illustrated in FIG. 2. In addition, the sample tube holder assembly 100 may include a sample tube holder rack 130. In some embodiments, the sample tube holder assembly 100 may include a base plate 110 configured to be disposed within the sample tube holder base 102 and engage a plurality of sample tube holder racks 130, as shown in FIGS. 3A and 3B. The sample tube holder rack 130 may be configured to receive a plurality of sample tubes 170 therein. According to some embodiments, each of the sample tubes 170 may include a sample tube identifier 172. As shown in FIG. 1, the sample tube identifiers 172 on each of the sample tubes 170 are visible when the sample tube holder racks 130 are positioned within the base 102 due to the offset between each of the sample tube holder racks as explained in further detail below.

As shown in FIG. 2, a sample tube holder base 102 may be rectangular in shape. In some embodiments, the sample tube holder base 102 may define a base cavity 104. Specifically, the sample tube holder base 102 may comprise an interior perimeter surface 108 and a base cavity bottom surface 106. The interior perimeter surface 108 and the base cavity bottom surface 106 may define the base cavity 104. According to some embodiments, the base cavity 104 may be rectangular in shape. Thus, the base cavity 104 may be reciprocal in shape to the sample tube holder base 102. Although the sample tube holder base 102 and the base cavity 104 are illustrated in FIGS. 2 and 3A to have a reciprocal rectangular shape, one of ordinary skill in the art will appreciate that the base 102 and base cavity 104 may be any number of shapes and configurations, such as cylindrical or the like. In addition, the base 102 may be sized and configured to be received within a centrifuge bucket or similar centrifuge device for spinning the sample tubes stored within the sample tube holder base 102. Further, FIG. 3B illustrates the base cavity 104 being rectangular in shape, but also including a base groove 114 and a base tongue 116. The base groove 114 and the base tongue 116 may be defined by the interior peripheral surface 108 of the sample tube holder base 102 and include various configurations as discussed in greater detail below.

Figure 8A:
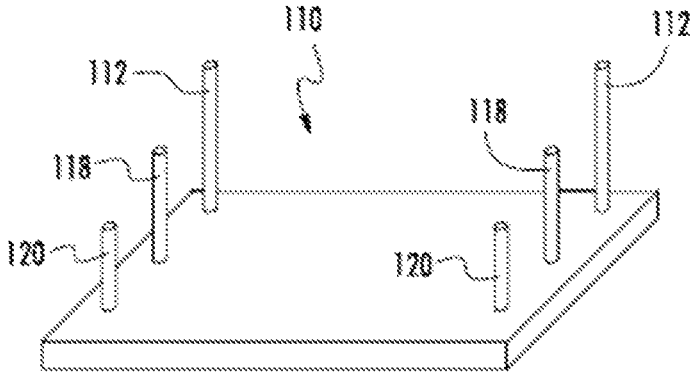
FIG. 8A illustrates a base plate according to some embodiments of the present invention.
Figure 8B:
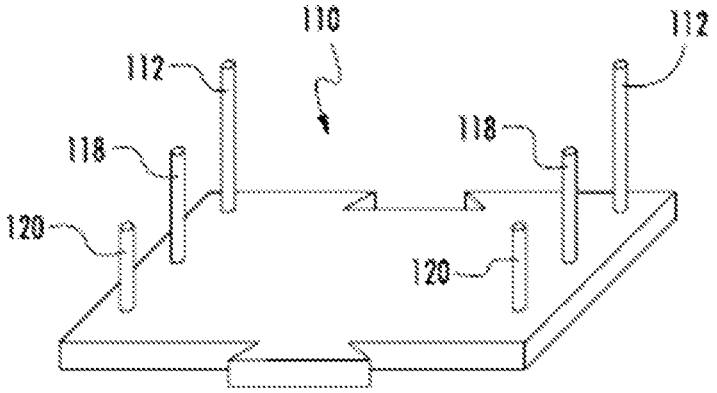
FIG. 8B illustrates a base plate according to some embodiments of the present invention.

FIG. 2 illustrates a view of the sample tube holder base 102 when the base cavity 104 is not occupied with a plurality of sample tube holder racks 130 and a base plate 110 according to one embodiment of the present invention. FIGS. 3A and 3B illustrate a top view of the tube holder base 102 when the base plate 110 is positioned within the base cavity 104 according to various embodiments of the present invention. In some embodiments, the interior peripheral surface 108 of the sample tube holder base 102 may further include a base groove 114 and a base tongue 116, as shown in FIG. 3B. The base groove 114 and the base tongue 116 may be configured to align and couple at least one sample tube holder rack 130 with the sample tube holder base 102. Although FIG. 3B illustrates the interior peripheral surface 108 of the tube holder base 102 including a base groove 114 and a base tongue 116 to align and couple at least one sample tube rack 130 with the tube holder base 102, the interior peripheral surface 108 of the tube holder base 102 may define a base cavity 104 such that when the plurality of sample tube holder racks 130 are disposed within the base cavity 104, the sample tube holder racks 130 are engaged with the interior perimeter surface 108 of the tube holder base 102 in a friction fit so as to maintain alignment. As shown in FIG. 8B, the base plate 110 may further include a base plate tongue and/or a base plate groove configured to align with a corresponding base groove 114 and/or a base tongue 116. As such, when the base plate 110 is inserted within the base cavity 104, the base groove 114 and/or base tongue 116 may align and assist coupling the base plate 110 to the sample tube holder base 102. Moreover, it is also understood that the internal peripheral surface 108 and the base plate 110 may include various engagement features or joints to facilitate engagement with one another and the sample tube holder racks 130 such that the illustrated groove and tongue configurations are not meant to be limiting. These engagement features may be located on any desired surface of the base 102 or base plate 110 to facilitate such engagement therebetween.

FIGS. 3A and 3B further illustrate a plurality of rack posts 112, 118, 120 extending vertically from a base plate 110 disposed on a cavity bottom surface 106. According to some embodiments, the rack posts 112, 118, 120 may vary in length, as shown in FIGS. 8A and 8B. In some embodiments, a first pair of rack posts 112 may extend a first length from the base plate 110, a second pair of rack posts 118 may extend a second length from the base plate, and a third pair of rack posts 120 may extend a third length from the base plate. According to some embodiments, the first length may be greater than the second length, which may be greater than the third length. In addition, the first length, second length, and third length of the respective rack posts may be a fixed length. Thus, the rack posts 112, 118, 120 may be arranged in a series of rows, with each row comprising a plurality of rack posts having a particular length.

In another embodiment, the plurality of rack posts 112, 118, 120 may extend vertically from the base plate 110 from an initial position to an extended position. According to one embodiment, the plurality of rack posts 112, 118, 120 may extend from an initial position to an extend position by an actuator, such a pneumatic actuator, an electrical actuator, a piezoelectric actuator, and/or the like. In some embodiments, a first pair of rack posts 112 may extend from an initial position to a first extended position, a second pair of rack posts 118 may extend from an initial position to a second extended position, and a third pair of rack posts 120 may extend from an initial position to a third extended position, wherein the length of the first extended position is greater than the length of the second extended position, which is greater than the length of the third extended position. In another embodiment, each post or rows of posts could be actuated to extend vertically. In some embodiments, the first pair of rack posts, second pair of rack posts, and third pair of rack posts may be disposed in a sequential order from one end of the base plate 110 to an opposite end of the base plate 110. Although embodiments of the present invention illustrated in the figures provide for three pairs of rack posts, one skilled in the art will appreciate that some embodiments may include any number and/or pair of rack posts.

Figure 5A:
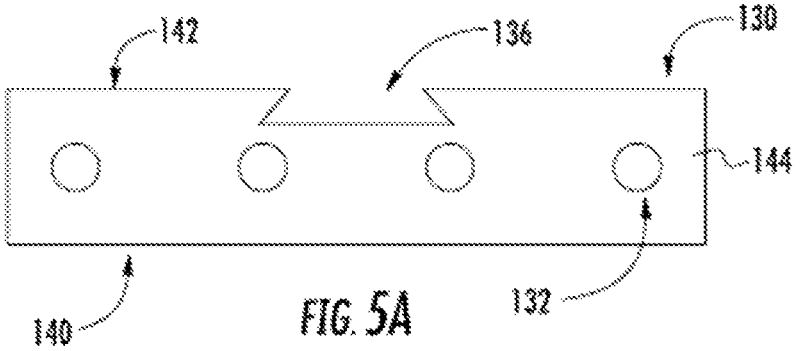
FIG. 5A illustrates a top view of a sample tube holder rack according to some embodiments of the present invention.
Figure 5B:
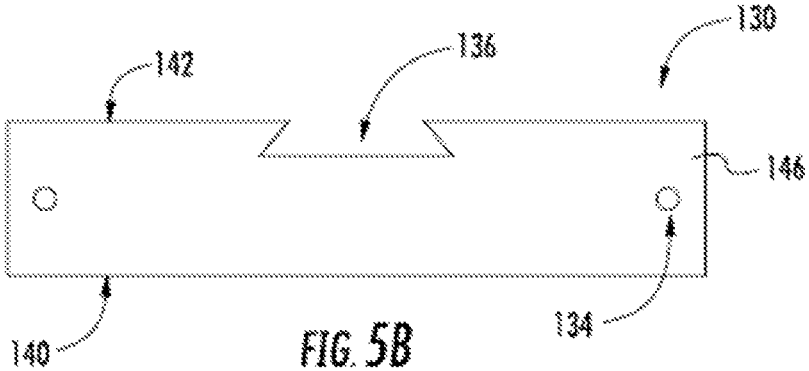
FIG. 5B illustrates a bottom view of a sample tube holder rack according to some embodiments of the present invention.
Figure 5C:
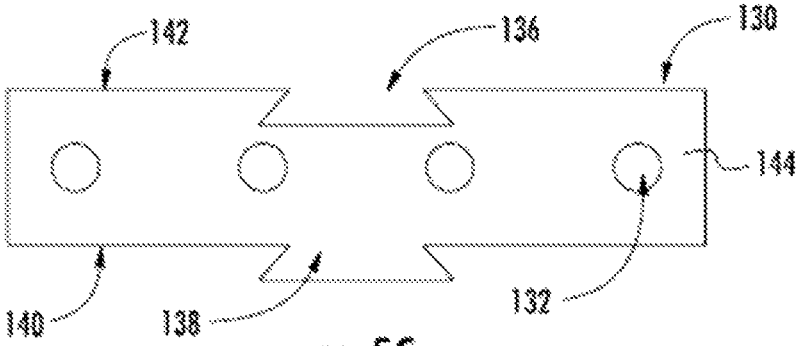
FIG. 5C illustrates a top view of a sample tube holder rack according to some embodiments of the present invention.
Figure 5D:
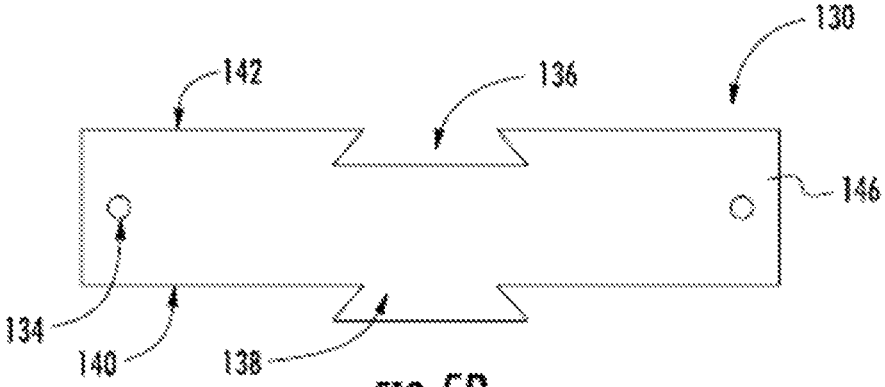
FIG. 5D illustrates a bottom view of a sample tube holder rack according to some embodiments of the present invention.
Figure 5E:
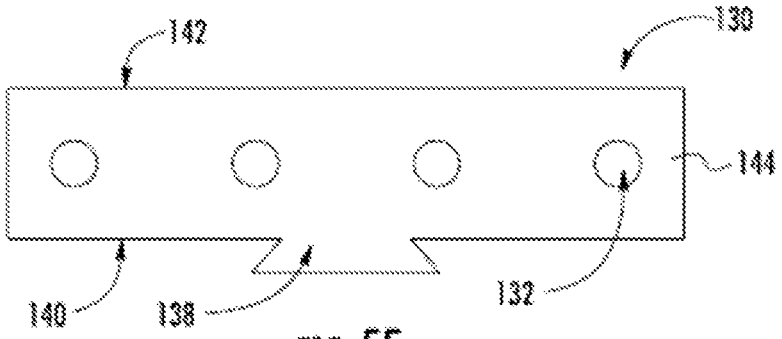
FIG. 5E illustrates a top view of a sample tube holder rack according to some embodiments of the present invention.
Figure 5F:
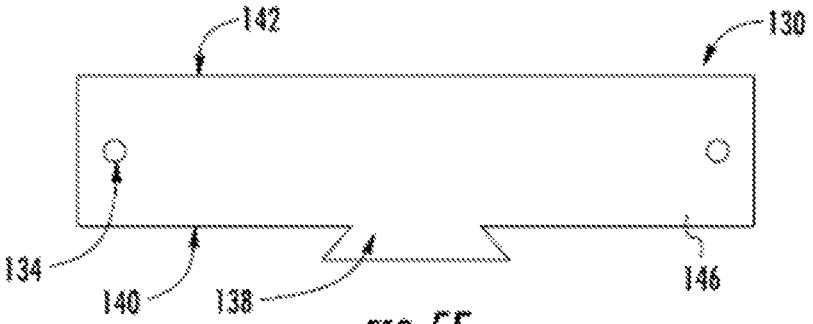
FIG. 5F illustrates a bottom view of a sample tube holder rack according to some embodiments of the present invention.

In addition, the sample tube holder racks 130 may include a plurality of rack post cavities 134. FIGS. 5B, 5D and 5F illustrate a bottom view of a sample tube holder rack 130 according to various embodiments. The rack bottom surface 146 of the sample tube holder rack 130 may include a plurality of rack post cavities 134 configured to receive the rack posts 112 therein. In one embodiment, the rack post cavities 134 may be recessed an equal distance from the bottom surface 146 of the sample tube holder rack 130. According to some embodiments, the rack posts 112 may engage the rack post cavities 134 in a friction fit. Specifically, at least one rack post 112 extending from the bottom surface of the base cavity 104 aligns with at least one rack post cavity 134 such that the sample tube holder rack 130 may be positioned and/or aligned within the base cavity 104.

According to some embodiments, the base plate 110 may be configured to rest upon the cavity bottom surface 106. As such, the rack posts 112 may extend from the cavity bottom surface 106 into the interior of the base cavity 104. The plurality of rack posts 112 may be further configured to engage a corresponding plurality of rack post cavities 134 defined by the sample tube holder rack 130. Accordingly, when a sample tube holder rack 130 is inserted into the base cavity 104, the plurality of rack posts 112 may engage the rack post cavities 134. As such, the plurality of the rack posts 112 may advantageously align and couple a plurality of sample tube holder racks 130 to the sample tube holder base 102. As the length of the rack posts 112 differ, a first rack will extend a first length from the base 102 equivalent to the first length of the rack post, a second rack will extend a second length from the base 102 equivalent to the second length of the rack post, and a third rack will extend from the base 102 equivalent to the third length of the rack post.

Figure 5G:
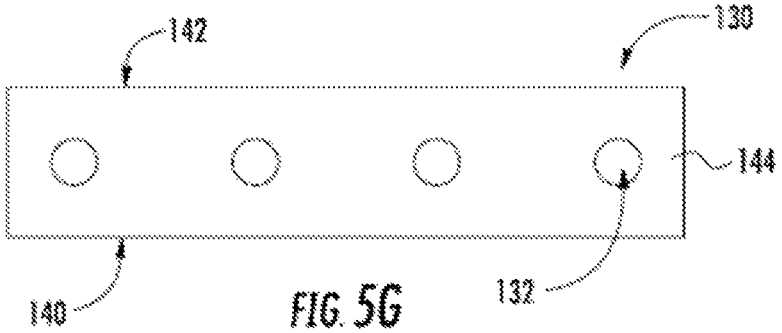
FIG. 5G illustrates a top view of a sample tube holder rack according to some embodiments of the present invention.
Figure 5H:
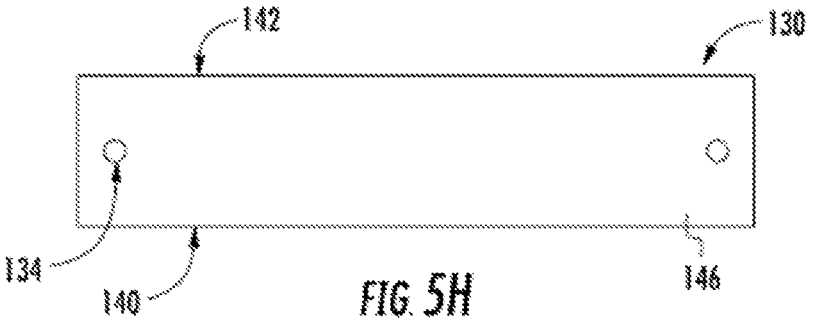
FIG. 5H illustrates a bottom view of a sample tube holder rack according to some embodiments of the present invention.

It is understood that the illustrated rack posts 112, 118, 120 and rack post cavities 134 are not meant to be limiting, as the posts may be different sizes and configurations in alternative embodiments. For example, the sample tube holder rack 130 may include any suitable engagement member, such as a hole, cavity, and/or the like, configured to engage a corresponding engagement member associated with the base 106 and/or base plate 110. Likewise, any number of engagement members may be used per sample tube holder rack 130, such as one or more engagement members. In addition, as shown in FIGS. 5G and 5H, one of the sample tube holder racks 130 may not include any engagement members such that one of the sample tube holder racks is configured to be positioned directly on the base 106 and/or base plate 110, while the remaining sample tube holder racks may include engagement members for facilitating the position thereof at different depths within the base cavity 104. Accordingly, the base 106 and/or base plate 110 may include a number of engagement members that are configured to engage each of the sample tube holder racks except one. Furthermore, the base plate 110 may not be necessary in some embodiments. For example, the rack posts 112 or other engagement members may extend directly from the bottom surface of the base 102 within the base cavity 104. In addition, the base plate 110 could be separately formed from the base 102 or integrally formed therewith in alternative embodiments. The rack posts 112 may be coupled to the base 102 or base plate 110 using any securement technique known to those skilled in the art, such as a friction fit, a weld, or an adhesive.

In another embodiment of the present invention, a base plate may include a plurality of rack posts that extend an equivalent length. In an embodiment where the rack posts extend an equivalent length from the base plate, the offset functionality of the sample tube holder assembly may be achieved by varying the depth of the rack post cavities of a sample tube holder rack. The rack post cavities of a first sample tube holder rack may have an equivalent depth. A second sample tube holder rack may have a plurality of rack post cavities that have an equivalent depth with respect to one another. However, the rack post cavities of the second sample tube holder rack will have a differing depth than the rack post cavities of the first sample tube holder rack.

Figure 4A:
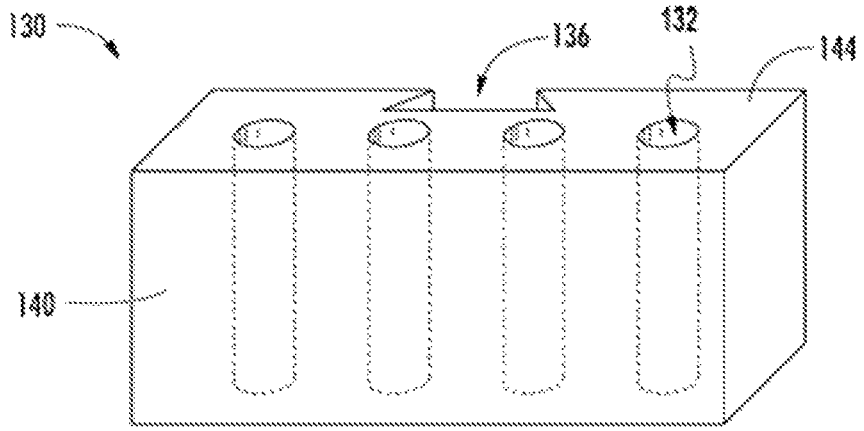
FIG. 4A illustrates a sample tube holder rack according to some embodiments of the present invention.
Figure 4B:
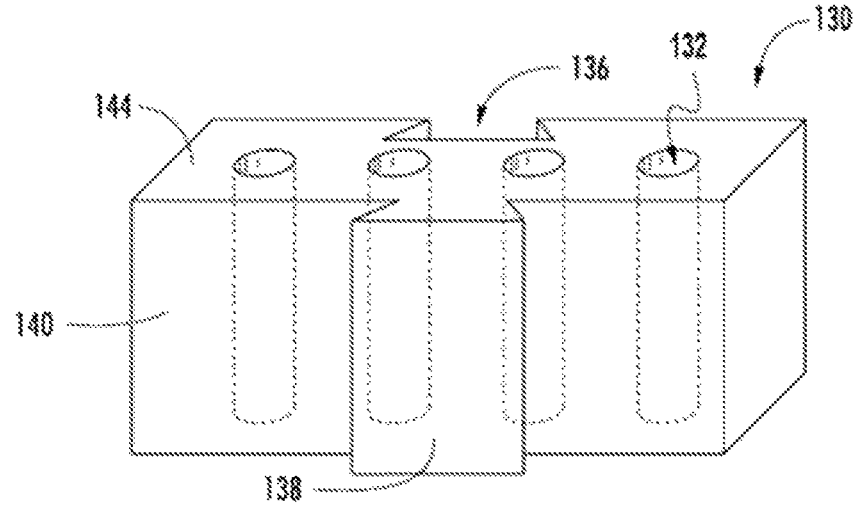
FIG. 4B illustrates a sample tube holder rack according to some embodiments of the present invention.
Figure 4C:
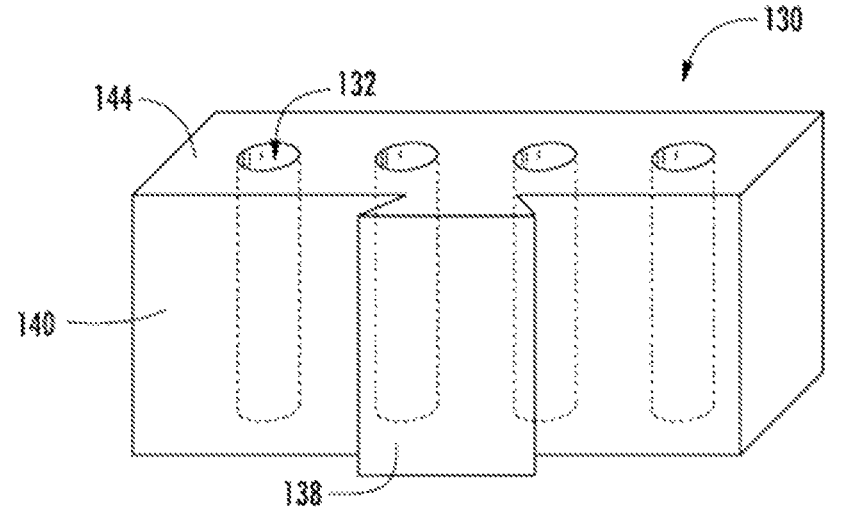
FIG. 4C illustrates a sample tube holder rack according to some embodiments of the present invention.

FIGS. 4A, 4B and 4C illustrate sample tube holder racks 130 according to various example embodiments of the present invention. The sample tube holder racks 130 may include a plurality of rack sample tube cavities 132 extending from a top surface 144 of the sample tube holder racks and at least partially therethrough. Although the embodiments illustrated in FIGS. 4A, 4B and 4C illustrates a sample tube holder rack 130 having four rack sample tube cavities 132, one skilled in the art will appreciate that a sample tube holder rack 130 may have any number of rack sample tube cavities 132.

FIGS. 4B and 4C illustrate a sample tube holder rack 130 that includes at least one rack tongue 138 according to one embodiment. A front rack surface 140 and/or a rear rack surface 142 may define a rack tongue 138 that has a first geometry, such as a trapezoidal geometry, as shown in FIGS. 5A-5F. Although the rack tongue 138 is shown to have a trapezoidal geometry, one skilled in the art may appreciate that the rack tongue may be shaped in any number of geometries. In addition, FIGS. 4A and 4B illustrate a sample tube holder rack 130 that includes at least one rack groove 136 according to embodiments of the present invention. A front rack surface 140 and/or a rear rack surface 142 may define a rack groove 136 that has a second geometry. According to some embodiments, the first geometry and the second geometry may be configured to be reciprocal geometries. Specifically, the first geometry of a rack tongue 138 may be configured to mate with a rack groove 136 that has a second geometry. For example, the trapezoidal geometry of the rack tongue 138 allows for a first sample tube holder rack 130 to couple with the rack groove 136 of a second sample tube holder rack 130, as shown in FIG. 1. Further, the reciprocal geometries of a rack tongue 138 and a rack groove 136 are configured to provide for the vertical movement of a first sample tube holder rack 130 with respect to a second tube holder rack 130 and prevent horizontal movement of the first tube holder rack 130 with respect to a second tube holder rack 130.

In some embodiments, a sample tube holder rack 130 may include both a rack tongue 138 and a rack groove 136. As shown in FIG. 4B, a sample tube holder rack 130 may include a front rack surface 140 that defines a rack tongue 138 and a rear rack surface 142 that defines a rack groove 136. Although FIGS. 4A, 4B, and 4C illustrate sample tube holder racks 130 with a front rack surface defining a rack tongue 138 and/or a rear rack surface defining a rack groove 136, one skilled in the art may appreciate that any surface of the sample tube holder rack may define a rack engagement feature, such as a rack groove, a rack tongue, or other engagement feature. Further, one skilled in the art may appreciate that a sample tube holder rack may have an additional surface defining a rack groove, a rack tongue, or other engagement feature opposite from the other rack groove, rack tongue, or other engagement feature such that a plurality of sample tube holder racks may be configured to be coupled to one another.

Figure 6:
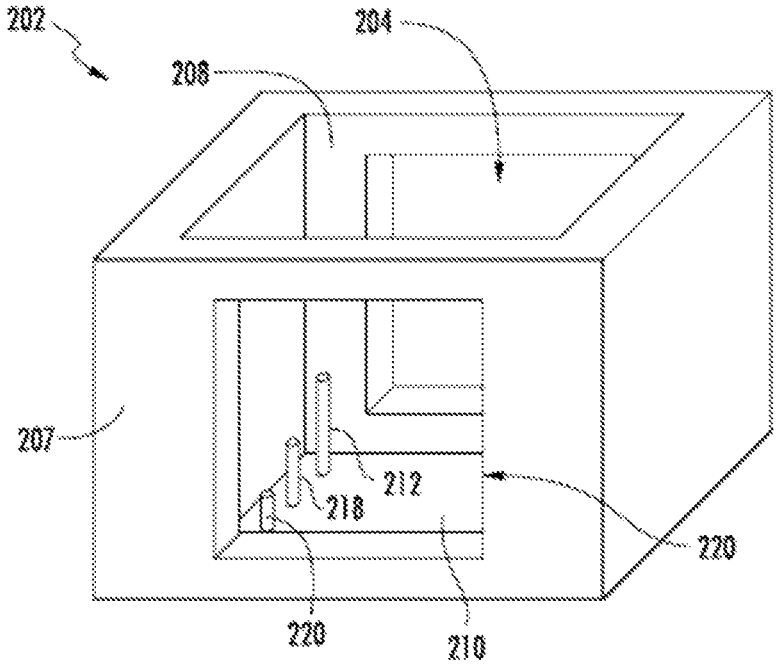
FIG. 6 illustrates a sample tube holder base according to some embodiments of the present invention.

According to some embodiments, a base 202 may further define at least one base aperture 220 for providing visibility therein, as shown in FIG. 6. Specifically, a base aperture 220 may be defined to extend completely through at least one of the sidewalls of the base 202 from an exterior perimeter surface 207 of the sidewall of the base to an interior perimeter surface 208 of the sidewall of the base 202. In some embodiments, a base aperture 220 may be defined to extend from one exterior surface of the base to an opposite exterior surface of the base. According to some embodiments, the base may define multiple apertures defined to extend between an exterior perimeter surface 207 of the base and an interior perimeter surface 208 defined by the base cavity. As such, the base 202 may include at least one aperture 220 configured to provide a view of the base cavity. Further, the base aperture 220 may be configured to provide a view of at least one sample tube holder rack 230 when the sample tube holder rack 230 is positioned within the base cavity 204. As such, the base 202 may be configured to be received within a centrifuge bucket or similar centrifuge device for spinning the sample stored within the sample tubes 270. Further, the base aperture 220 may be configured to provide for viewing the sample and/or identifying the sample after being subjected to a processing step, such as being spun by a centrifuge.

Figure 7:
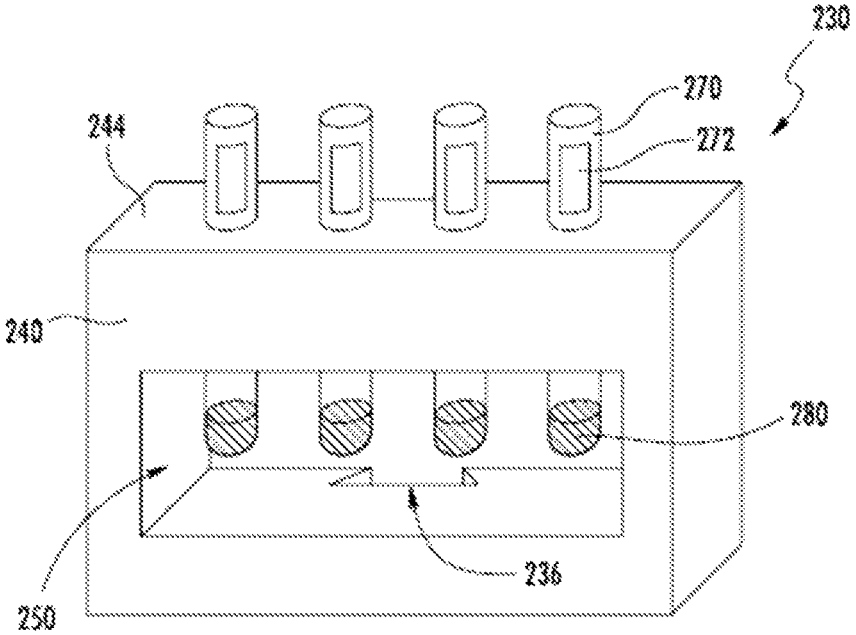
FIG. 7 illustrates a sample tube holder rack according to some embodiments of the present invention.

In some embodiments, a sample tube holder rack 230 may further include at least one rack aperture 250. As shown in FIG. 7, the sample tube holder rack 230 may define a rack aperture 250 extending from a front rack surface 240 to a rear rack surface (not shown). Specifically, the rack aperture 250 may extend from a first surface to an opposite surface such that the aperture extends entirely through the thickness of the sample tube holder rack. Thus, any of the sample tubes 270 engaged with the sample tube holder rack 230 may be visually inspected though the rack aperture 250. For example, a sample 280 disposed within the sample tube 270 may be viewed through the rack aperture 250 when the sample tube 270 is stored within the sample tube holder rack 230. In another embodiment, the rack aperture 250 may be configured to provide a view of a sample 280 disposed within a sample tube 270 stored within the sample tube holder rack 230 such that a user may aspirate, access, meter and/or otherwise manipulate a sample 280 disposed within a sample tube 270 stored within the sample tube holder rack 230.

Figure 9:
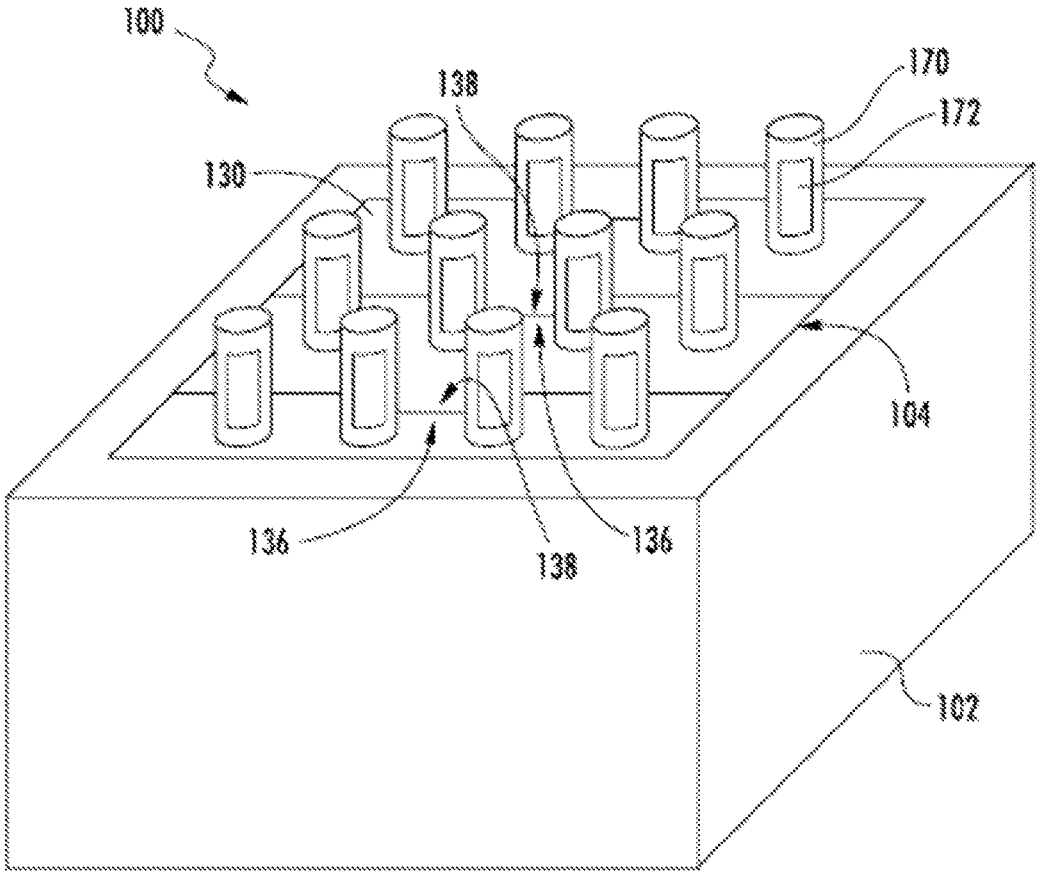
FIG. 9 illustrates an assembly for storing and/or identifying specimen samples within sample tubes according to some embodiments of the present invention.

According to one embodiment, the sample tube holder assembly 100 may be configured such that the sample tubes 170 are disposed along the same plane when the offset functionality is not required and/or desired, as shown in FIG. 9. For example, the base plate 110 may be removed from the sample tube holder base 102, and a plurality of sample tube holder racks 130 may be inserted within the base cavity 104 of the sample tube holder base 102. As such, the plurality of sample tube holder racks 130 may reside within the base cavity 104 and upon the same horizontal plane. Specifically, the plurality of rack post cavities 134 of any of the sample tube holder racks 130 will not engage a rack post 112 as the base plate 110 has been removed from the base cavity 104.

As such, embodiments of the present invention provide a number of advantages, such as easier identification of sample tubes during processing, manipulation, and/or other handling while the sample tube is positioned within a base, holder, and/or other apparatus. As such, embodiments of the present invention may lessen user errors by substantially eliminating a need to remove a sample tube from a base, holder and/or other apparatus to identify the sample tube. Additionally and/or alternatively, embodiments of the present invention may lessen user error by substantially eliminating a need to remove a sample tube from a base, holder, and/or other apparatus to meter, aspirate, and/or otherwise manipulate a sample stored within a particular sample tube.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed. Although specific terms are employed herein, they are used in a generic and descriptive sense only and not for purposes of limitation.

That which is claimed:

1. A sample tube holder assembly comprising:

a base comprising a base cavity defined therein;

at least one first engagement member disposed within the base cavity; and a plurality of sample tube holder racks configured to be received within the base cavity, at least one of the sample tube holder racks comprising at least one second engagement member, wherein each of the plurality of sample tube holder racks further comprises at least one sample tube cavity configured to receive a respective sample tube therein, wherein the first and second engagement members are configured to engage with one another when the plurality of sample tube holder racks are positioned within the base cavity such that the sample tube holder racks are offset at a different depth from one another within the base cavity, wherein either the first or second engagement member is entirely disposed within the other of the first or second engagement member when the first and second engagement members are engaged, and wherein the first engagement member comprises a rod and the second engagement member comprises a rod cavity.

2. The sample tube holder assembly of claim 1, wherein each of the plurality of sample tube holder racks includes a top surface and a bottom surface, wherein the at least one sample tube cavity is defined on the top surface and the at least one second engagement member is defined on the bottom surface.

3. The sample tube holder assembly of claim 1, further comprising a plurality of first engagement members, and wherein the first engagement members have different lengths.

4. The sample tube holder assembly of claim 3, wherein the base comprises a front surface and a rear surface, and wherein at least one of the first engagement members disposed proximate to the rear surface has a greater length than at least one of the first engagement features disposed proximate to the front surface.

5. The sample tube holder assembly of claim 1, further comprising a plurality of first engagement members, wherein each of the sample tube holder racks comprises a plurality of second engagement members, each of the second engagement members configured to engage a respective one of the first engagement members.

6. The sample tube holder assembly of claim 5, wherein the plurality of first engagement members are arranged in a series of rows, each of the rows having a plurality of engagement members that are of a different length than another row.

7. The sample tube holder assembly of claim 1, wherein the base is configured to receive at least three sample tube holder racks within the base cavity.

8. The sample tube holder assembly of claim 1, wherein each of the plurality of sample tube holder racks is configured to receive a respective sample tube therein such that sample tube indicia disposed on each of the sample tubes is visible when the sample tube is inserted within the sample tube holder rack.

9. The sample tube holder assembly of claim 1, wherein the base is configured to engage a centrifuge device configured to spin a sample stored disposed within the sample tubes.

10. A sample tube holder assembly comprising:

a base comprising a base cavity defined therein;

at least one first engagement member disposed within the base cavity;

a base plate configured to be received within the base cavity, wherein the first engagement member extends outwardly from a top surface of the base plate; and a plurality of sample tube holder racks configured to be received within the base cavity, at least one of the sample tube holder racks comprising at least one second engagement member, wherein each of the plurality of sample tube holder racks further comprises at least one sample tube cavity configured to receive a respective sample tube therein, wherein the first and second engagement members are configured to engage with one another when the plurality of sample tube holder racks are positioned within the base cavity such that the sample tube holder racks are offset at a different depth from one another within the base cavity, and wherein either the first or second engagement member is entirely disposed within the other of the first or second engagement member when the first and second engagement members are engaged.

11. A sample tube holder assembly comprising:

a base comprising a base cavity defined therein;

at least one first engagement member disposed within the base cavity; and a plurality of sample tube holder racks configured to be received within the base cavity, at least one of the sample tube holder racks comprising at least one second engagement member, wherein each of the plurality of sample tube holder racks further comprises at least one sample tube cavity configured to receive a respective sample tube therein, wherein the first and second engagement members are configured to engage with one another when the plurality of sample tube holder racks are positioned within the base cavity such that the sample tube holder racks are offset at a different depth from one another within the base cavity, wherein either the first or second engagement member is entirely disposed within the other of the first or second engagement member when the first and second engagement members are engaged, and wherein each of the sample tube holder racks further comprises at least one rack engagement feature defined on an outer surface thereof and configured to couple at least one sample tube holder rack to another sample tube holder rack.

12. The sample tube holder assembly of claim 11, wherein the at least one rack engagement feature provides a tongue and groove engagement.

13. A sample tube holder assembly comprising:

a base comprising a base cavity defined therein;

at least one first engagement member disposed within the base cavity; and a plurality of sample tube holder racks configured to be received within the base cavity, at least one of the sample tube holder racks comprising at least one second engagement member, wherein each of the plurality of sample tube holder racks further comprises at least one sample tube cavity configured to receive a respective sample tube therein, wherein the first and second engagement members are configured to engage with one another when the plurality of sample tube holder racks are positioned within the base cavity such that the sample tube holder racks are offset at a different depth from one another within the base cavity, wherein one of the first or second engagement member is entirely disposed within the other of the first or second engagement member when the first and second engagement members are engaged, wherein the other of the first or second engagement member includes a surface and a cross-sectional area measured in a plane parallel to the base cavity, the surface facing a center of the cross-sectional area and forming an inward facing closed perimeter, and wherein the surface of the other of the first or second engagement member directly faces at least part of the first or second engagement member that is entirely disposed in the other of the first or second engagement member when the first and second engagement members are engaged.

* * * * *